US006824135B2

(12) United States Patent
Stancik

(10) Patent No.: US 6,824,135 B2
(45) Date of Patent: Nov. 30, 2004

(54) DOUBLE WIN GAME

(75) Inventor: Robert G. Stancik, Chagrin Falls, OH (US)

(73) Assignee: Arrow International, Inc., Cleveland, OH (US)

( * ) Notice: Subject to any disclaimer, the term of this patent is extended or adjusted under 35 U.S.C. 154(b) by 0 days.

(21) Appl. No.: 10/289,860

(22) Filed: Nov. 7, 2002

(65) Prior Publication Data

US 2003/0132576 A1 Jul. 17, 2003

Related U.S. Application Data

(60) Provisional application No. 60/344,554, filed on Nov. 9, 2001.

(51) Int. Cl.[7] ..... A63F 1/00

(52) U.S. Cl. ..... 273/139; 273/138.1; 283/901; 283/903

(58) Field of Search ..... 273/138, 139, 273/292, 296; 283/901, 903, 905

(56) References Cited

U.S. PATENT DOCUMENTS 5,046,737 A 9/1991 Fienberg
5,407,200 A * 4/1995 Zalabak ..... 273/139
5,671,921 A * 9/1997 Quinlan ..... 273/139
5,743,524 A * 4/1998 Nannicola ..... 273/139
5,788,237 A 8/1998 Fults et al.
5,931,468 A * 8/1999 Orolin ..... 273/139
5,934,671 A * 8/1999 Harrison ..... 273/139
6,390,916 B1 * 5/2002 Brown ..... 463/17

* cited by examiner

*Primary Examiner*—Kurt Fernstrom
(74) *Attorney, Agent, or Firm*—Fay, Sharpe, Fagan, Minnich & McKee, LLP

(57) ABSTRACT

A "lottery-type" game of chance for a plurality of players employs break open playing cards (10), at least some of the playing cards having printed on them one or more instant win awards. The awards are covered, prior to play, with one or more removable cover members (32) such as flaps or scratch off seals. Some of the playing cards include an eligible game symbol (52) which entitles the playing card holder to enter a second round of play. An identifier (60) on a master game card (12) is revealed to identify which of the eligible second round players has the opportunity to select a bonus round ticket or "double win" ticket (70). The bonus round ticket, upon opening of cover members (80) reveals one of a set of predetermined instructions which provide for all or a portion of the bonus or "double win" round prize to go to the bonus round player, the remainder going to specified ones of the other eligible second round players.

20 Claims, 4 Drawing Sheets

INSTRUCTIONS FOR PLAY

THE SEAL WINNER WINS $500 AND THEN PAYS $1 AND PICKS ONE OF THE 4 DOUBLE WIN PRIZE TICKETS ATTACHED AT BOTTOM OF SEAL CARD. THE DOUBLE WIN PRIZES COULD GO UP TO $500 OR THEY WILL SHARE THE DOUBLE WIN WITH OTHER SIGN UP HOLDERS.

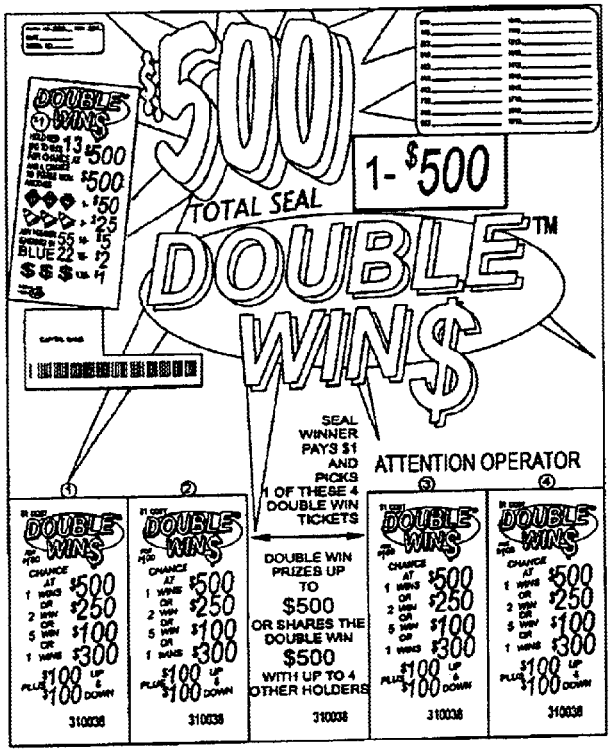

THE TICKETS WILL BE EITHER:

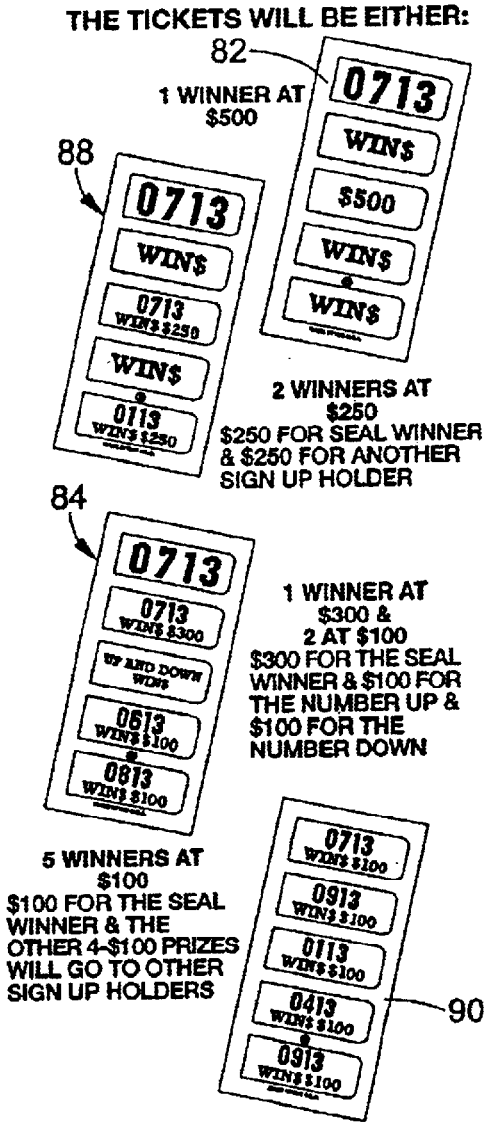

FORM H998 $1.00 per card

1896 cards @ $1.00.....$1896.00

PAYS OUT

| | | | | |
|---|---|---|---|---|
| 1 | Seal | @ | $500.00 | $500.00 |
| 1 | Seal | @ | $500.00 | $500.00 |
| 1 | Winner | @ | $50.00 | $50.00 |
| 2 | Winners | @ | $25.00 | $50.00 |
| 16 | Winners | @ | $5.00 | $80.00 |
| 16 | Winners | @ | $2.00 | $32.00 |
| 135 | Winners | @ | $1.00 | $135.00 |

DEFINITE PAYOUT.....$1347.00
DEFINITE PROFIT.....$549.00

71% payback 4 sets per case
Win Ratio: 1 in 11

FIG. 6

DOUBLE WIN GAME

This application claims the priority of U.S. Provisional Application Ser. No. 60/344,554, filed Nov. 9, 2001.

BACKGROUND OF THE INVENTION

The present invention relates to gaming systems and, more particularly, to a lottery-type gaming system.

Lottery-type games of chance have exhibited enduring popularity since such games typically permit a player to make a relatively small investment—by buying a ticket—with a chance of winning a significantly larger award. In addition to the entertainment value that such games provide for the players, these types of games typically provide a source of revenue for the operator, normally a charity, but sometimes a municipality or a business establishment.

One type of game system which has proven quite popular with players is the so-called break-open ticket game. In this type of game, players purchase playing cards for a relatively nominal sum, with each playing card displaying game symbols, selected ones of which correspond to award values. In a typical configuration, each playing card comprises a lamination of upper and lower plies of material, such as paper, with the game symbols displayed on the inside surface of the lower ply. The game symbols are thus initially sealed, and are revealed by "breaking open" one or more flap-like portions of the upper ply.

As will be appreciated, affording players an opportunity to win awards in different ways enhances the entertainment value of the game. The present game system contemplates an arrangement whereby selected players become eligible for a bonus award, with at least one of these players, in turn, having an opportunity to win the bonus.

It has, therefore, been considered desirable to develop a new and improved seal card game and method for playing same which would meet the above stated needs and others and provide advantageous overall results.

SUMMARY OF THE INVENTION

The lottery-type game system embodying the principles of the present invention provides multiple levels of play, including an arrangement whereby selected players become eligible for a bonus award, with at least one of the selected players thereafter having the opportunity to share in the bonus award. Thus, the overall system typically involves at least three levels of play for which all players are potentially eligible.

In accordance with one aspect of the present invention, a system for use in playing a game of chance is provided. The system includes a plurality of playing cards, each of the playing cards including at least one of a plurality of game symbols displayed thereon. Some of the playing cards display an eligible game symbol. A master game card is provided for use in conjunction with the playing cards. At least one of the master game card and playing cards includes a first identifier for identifying a first award. The master game card includes at least one winning game symbol selected from the eligible game symbols associated with the identified first award. One or more bonus round tickets are provided for use in conjunction with the master game card. The bonus round ticket has at least one bonus round award identifier for identifying a bonus round award and at least one bonus round winning game symbol selected from the eligible game symbols associated with the identified bonus round award.

In accordance with another aspect of the present invention, a system for use in playing a game of chance is provided. The system includes a plurality of playing cards. The playing cards include game symbols displayed thereon. Some of the playing cards display an eligible game symbol, each of the eligible game symbols being different from the other other eligible game symbols A master game card is provided for use in conjunction with the plurality of playing cards. At least one of the master game card and the playing cards includes means for identifying the eligible game symbols. The master game card includes means for identifying one of the eligible game symbols as a winning game symbol. A plurality of bonus round tickets are provided for use in conjunction with the master game card. The bonus round tickets each have at least one award identifier for identifying a bonus round award and at least one bonus round winning game symbol selected the the eligible game symbols associated with the identified bonus round award.

In accordance with another aspect of the present invention, a method of playing a game of chance is provided. The method includes distributing a plurality of playing cards to a plurality of players and removing at least one cover member on each of the playing cards to reveal at least one of a plurality of game symbols. Some of the playing cards include an eligible game symbol which is eligible for a first bonus round of play. In the first bonus round of play, uncovering a winning game symbol selected from the eligible game symbols associated with a first award. A holder of the playing card displaying the winning game symbol receives the first award. In a second bonus round of play, the holder of the playing card displaying the winning game symbol selects one of a plurality of bonus round tickets. The bonus round tickets each have at least one bonus round award identifier for identifying a bonus round award and at least one bonus round winning game symbol selected from the eligible game symbols associated with the identified bonus round award.

In accordance with another aspect of the present invention, a method of playing a game of chance is provided. The method includes distributing a plurality of playing cards to a plurality of players and removing cover members on the playing cards to reveal a plurality of game symbols. Some of the playing cards include a game symbol which is eligible for a bonus round of play. A winning game symbol selected from the eligible game symbols is uncovered. A holder of the playing card displaying the winning game symbol is permitted to select one of a plurality of bonus round tickets. The bonus round tickets each have at least one bonus round award identifier for identifying a bonus round award and at least one bonus round winning game symbol selected from the eligible game symbols associated with the identified bonus round award. At least one of the bonus round tickets identifying a bonus round award associated with the winning game symbol.

The advantages of the present invention will become apparent to those skilled in the art upon a reading and understanding of the following detailed specification.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein:

FIG. 6 is a top plan view of a set of instructions for play of the game of the present invention.

DETAILED DESCRIPTION OF THE PREFERRED EMBODIMENTS

Figure 4:
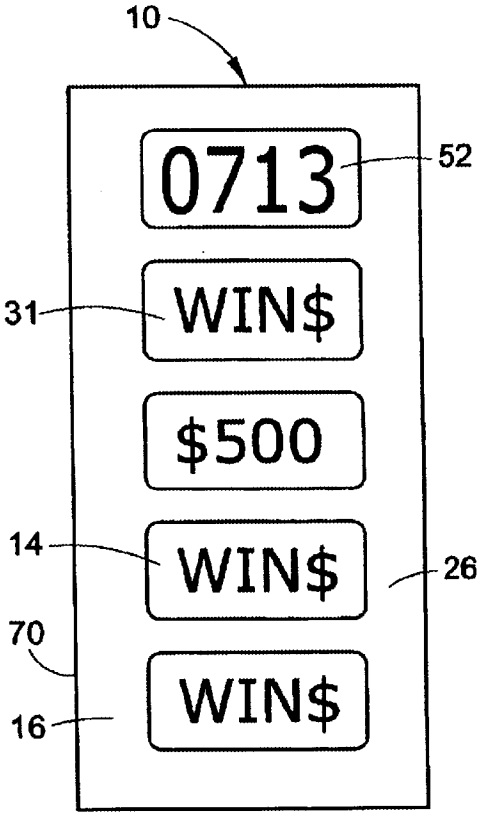
FIG. 4 is a top plan view of a bonus round ticket of the double win game system according to the present invention.

While this invention is susceptible of embodiment in many different forms, there is shown in the drawings and will herein be described in detail, a preferred embodiment of the invention. However, it should be understood that the Figures are to be considered only as exemplifying the principles of the invention and are not intended to limit the invention to the embodiment illustrated.

Figure 2:
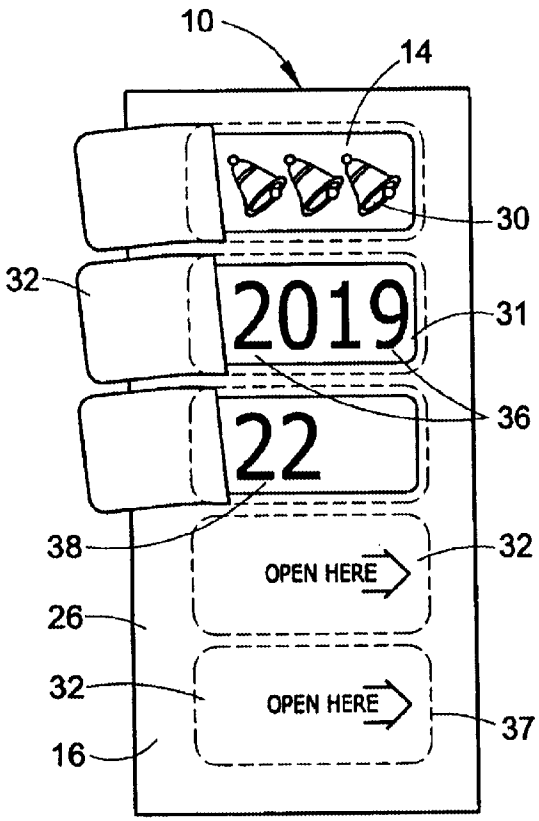
FIG. 2 is a top perspective view of a rear face of the playing card of FIG. 1 with three flaps opened.
Figure 1:
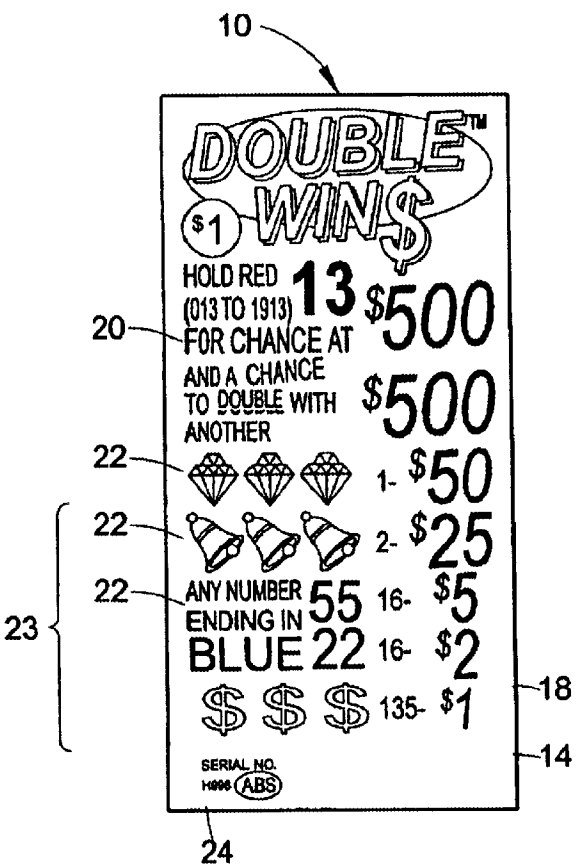
FIG. 1 is a top plan view of a front face of a playing card for a double win game system according to the present invention.
Figure 3:
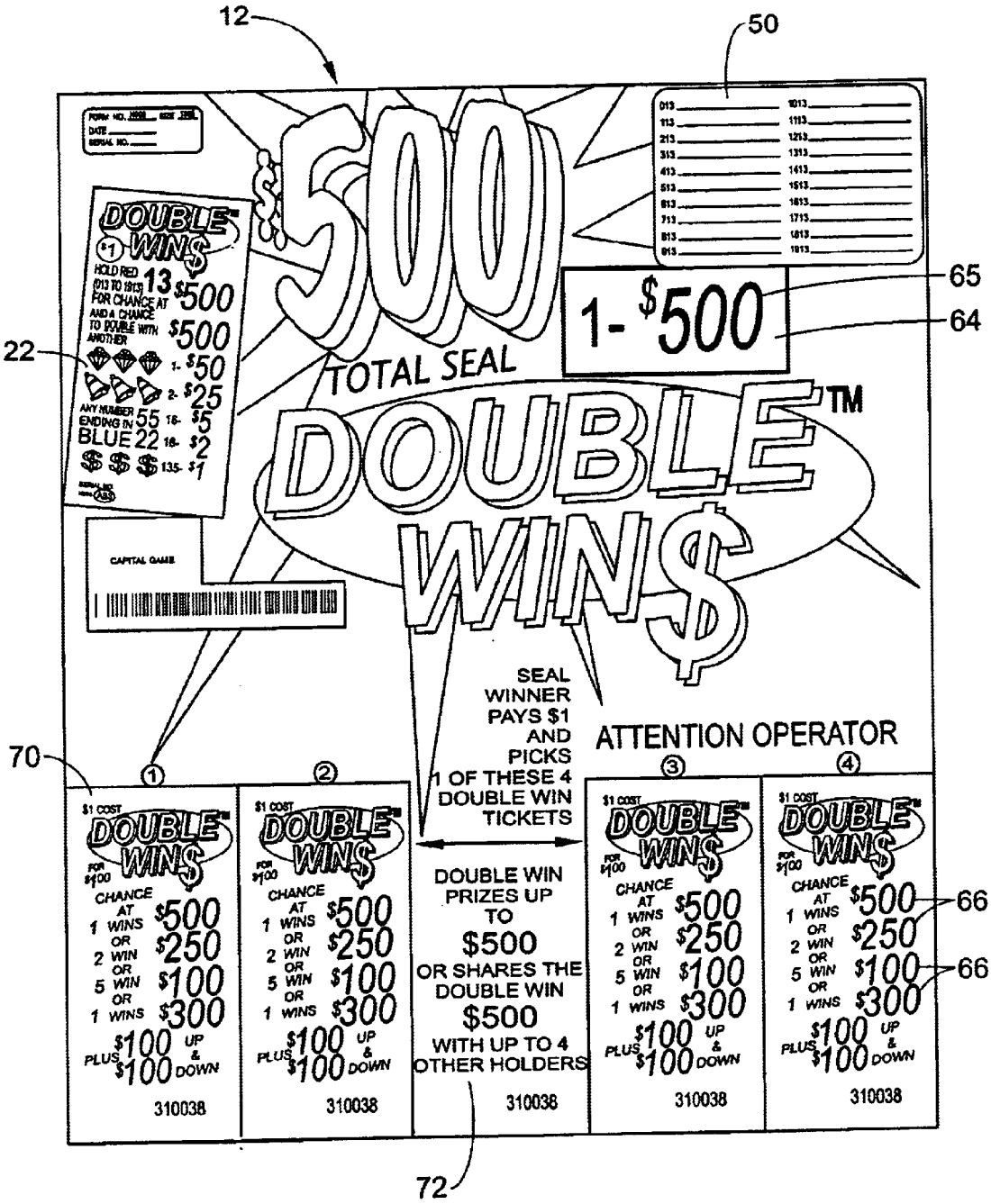
FIG. 3 is a top plan view of a master game card of the double win game system according to the present invention.

FIGS. 1 and 2 illustrate a ticket or playing card 10 and FIG. 3 illustrates a master game card 12 which are used in combination for playing a game of chance, namely a double win game system according to the present invention. Playing card 10 is intended as exemplary, in that the present game system includes a substantial number of such playing cards. In a preferred embodiment, about 2,000 cards are employed. Each of the playing cards is purchased by a game player for a nominal sum, such as $1.00. Certain ones of the players are eligible to participate in the selection of a bonus award winner on the master game card 12. The playing cards 10 are preferably packaged as a set, in a clear wrapping, together with the master game card 12.

Each of the playing cards 10 preferably comprises upper and lower layers or plies of material 14 and 16, laminated together at the edges of their inner surfaces, and formed from paper, card, or the like. An outer, first face 18 of one of the plies 14 may be used to display information about the game, such as the rules of the game 20, examples of winning combinations 22 of "instant-win" characters, and the like (see FIG. 1). The price of each playing card ($1.00 in the illustrated embodiment) is also printed on the first face 18 or elsewhere on the playing card. Alternatively, the first face 18 may be left blank. An identifying character, such as a serial number 24 is printed on the front face 18 (or a rear face 26 of the playing card 10) for identifying the playing card 10 as being part of the set of playing cards all with the same serial number and associated with a corresponding serial number printed on the master game card 12.

Each of the playing cards 10 displays at least one, more preferably, a plurality of game symbols 30 or groups 32 of game symbols. The game symbols 30 may be letters, numbers, characters, such as dollar signs, bells, and the like commonly associated with lottery games. Each of the cards 10 includes a single cover member, a plurality of cover members, or other game symbol concealing means 32. Preferably, the game symbols 30 are displayed on the inside surface 31 of the upper ply 14 of the card. This type of card 10 is typically referred to as a "break-open" playing card, in that the cover member comprises one or more flap-like portions 32 of the lower ply 16 (five flaps 32 are shown in FIG. 2) which cover groups 36 of game symbols 30. The flaps 32 can be selectively removed from each of the game symbols 30 or groups 36 of game symbols in order to reveal the game symbols, after the card 10 has been purchased. The flaps 32 have perforated edges 37, allowing them to be readily separated from the surrounding upper ply 16 material. However, it will be understood that a game embodying the principles of the present invention may include playing cards 10 and a master game card 12 otherwise configured, such as including "scratch-off" arrangements for initially concealing game symbols 30 or groups 36 of game symbols.

The game preferably has three or more levels of play, each succeeding level generally involving fewer of the game players (of course, one player may have purchased more than one card 10 for a greater chance of winning). In its first level of play, the present game system provides awards to those players having cards which display predetermined winning symbols or groups of winning symbols (hereinafter "winning symbols"). The majority of the winning symbols 38 are of an instant-win variety. The holder of a card 10 displaying an "instant win" winning symbol 38 is a winning game player, who then takes the winning card to a game organizer and receives the winning amount accorded to the particular winning symbol 38. To assist players in ascertaining winning cards at the first level of play, a listing 23 of winning groups is provided on the front face 18 of each playing card 10 and/or the master game card 12.

In its two additional levels of play, the present system permits selected ones of the players to become eligible for a first bonus award, and thereafter at least one of the eligible players plays for a second bonus award, through use of the master game card 12.

The second level of play of the present game system entails establishing selected game players who become eligible for the first and second bonus awards, with these players then listed on the master game card 12 in the illustrated embodiment. To this end, the master game card 12 includes a sign up area 50, for listing the selected, eligible players (FIG. 3). In the illustrated embodiment, the eligibility of these selected players is established by those players having cards 10 having predetermined selected eligible game symbols 52 of the game symbols 30. In the illustrated embodiment, such predetermined eligible game symbols 52 comprise numeric designations ending in 13 (i.e., 013, 113, 213, etc.). Each of the eligible game symbols 52 is printed on one of the playing cards 10 (see, for example, FIG. 4). On opening a flap 32 to reveal an eligible game symbol 52, the game player holding the card 10 enters his name on the sign up area 50 in the appropriate location (e.g., adjacent his eligible game symbol 52).

Figure 5:
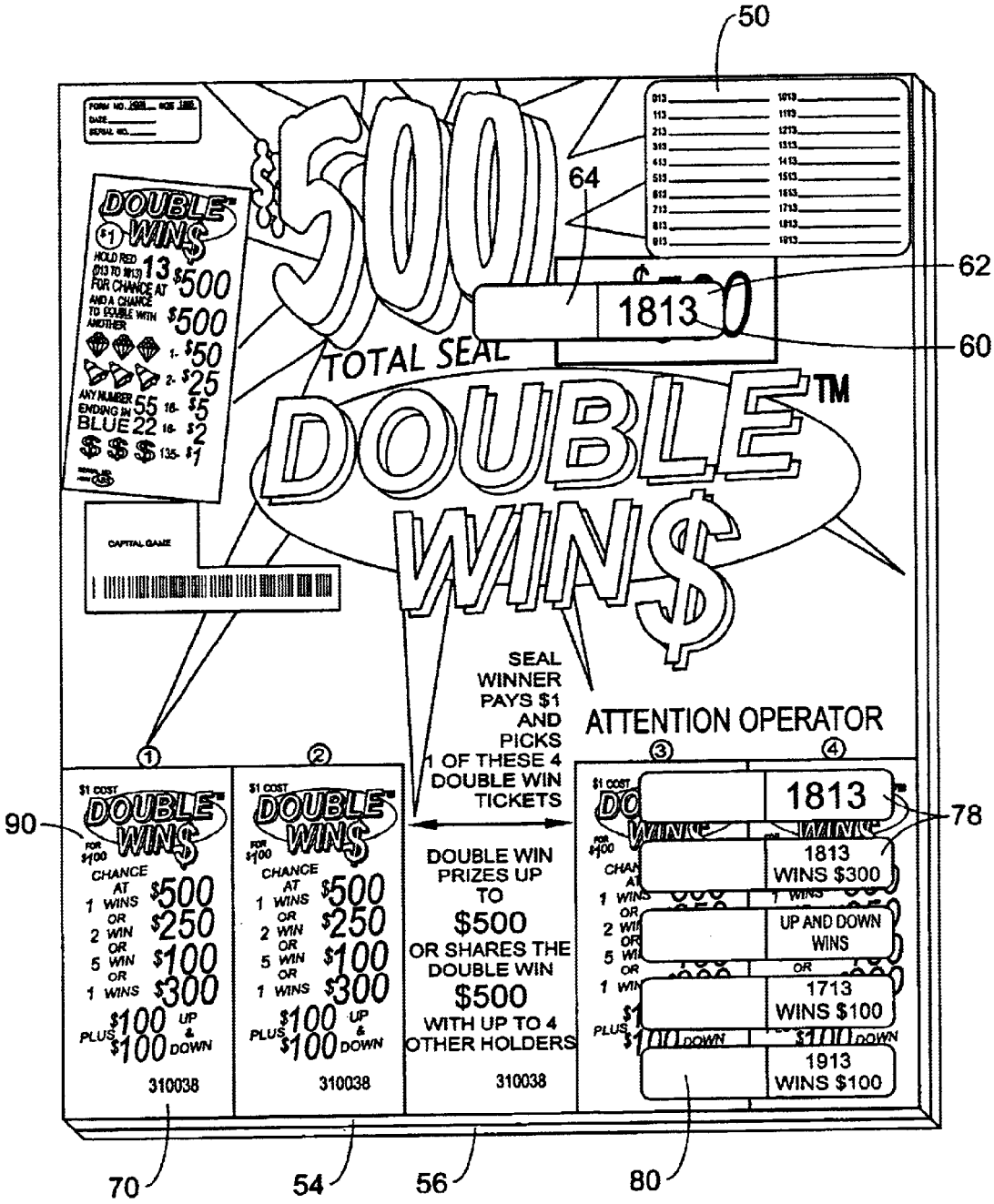
FIG. 5 is a top plan view of the master game card of FIG. 3 with the bonus flaps of one bonus round ticket open to reveal a bonus identifier and bonus round award instructions.

As shown in FIG. 5, the master game card 12 preferably comprises a lamination of upper and lower plies of material 54 and 56. The master game card 12 further includes an arrangement whereby at least one of the listed, eligible players is identified, with that player then being eligible to play for the second bonus award. This is provided by at least one bonus player identifier 60 on the master game card 12. For example, the identifier 60 is printed on an inside surface 62 of the lower ply 56 of the master game card 12, at a location spaced from the sign up area 50. The identifier is concealed by a selectively removable flap-like portion or seal 64 (shown pulled away in FIG. 5) of the upper ply 54 of the master game card 12. As will be noted, the identifier 60 corresponds to a predetermined one of the selected game symbols, such as the numeric symbol 1813.

As will be appreciated, the bonus player identifier 60 is preferably not revealed until all (or most) of the eligible selected players have been established, and entered in the sign up area 50, if provided. When the bonus player identifier 60 is revealed, that one player may automatically win a predetermined first bonus award 65 (e.g., $500.00 in the illustrated embodiment). Preferably the amount of the first bonus award 65 is indicated on the front face of the master card 12, for example, printed on the flap-like portion 64. While the illustrated embodiment includes a single bonus player identifier 60, a plurality of such identifiers 60 can alternately be provided. The identified player becomes eligible for entering the bonus level and winning a second bonus award or award 66, which award is determined by the bonus round or "double win" section of the master game card 12. Alternatively, a like plurality of the eligible players become further eligible to play the "double win section" of the master game card 12. In one embodiment, in order to play the bonus section of the master game card 12, the eligible player or players need to pay an additional sum of money, such as $1.00.

The bonus section of the master game card 12 provides the third level of play of the present system which allows not only the winning double win level entry player the chance to win a further prize, but also provides an opportunity for one or more of the non-winning eligible selected players listed on the sign up area 50 to win an additional prize. This maintains the excitement of the game for more than one player. In a preferred embodiment, the total amount of the prize for the double win round is fixed ($500.00 in the illustrated embodiment). It is awarded to one or more of the eligible players according to instructions printed on a bonus round ticket or "double win" ticket 70, or other preprinted set of instructions, which are not opened until the bonus round is played. As mentioned, the value of the "double win award" or second bonus award 66 is preferably prominently displayed at 72 on the master game card 12 and/or on the bonus tickets 70, so that all game players are aware of the potential bonus they might win or share in.

In the illustrated embodiment, the winning double win level entry player (the "double win player") whose card 10 displays the winning symbol 60, is given the opportunity to select one of a plurality of bonus round or "double win" tickets 70 (four in the illustrated embodiment), which, as shown in the illustrated embodiment, may be formed as part of the master game card 12 and be individually separable therefrom. As mentioned, the double win player is preferably required to pay an additional charge for the double win ticket 70 ($1.00 in the illustrated embodiment), although it is also contemplated that the double win ticket 70 may be issued free of charge. Perforated edges 76 of the double win tickets 70 are provided for ease of separation of the selected double win ticket 70 from the master game card 12. Each of the double win tickets 70 identifies award instructions 78, preferably printed on the inside surface of lower ply 56, each of which is concealed by a respective flap-like portion 80 of the upper ply 54. It is contemplated that the double win player will open all of, or at least some of, the flap-like portions 80. Each of the flaps 80 successively reveals more of the instructions so that the complete determination of the winners and amounts to be won may not be revealed until all the flaps 80 are opened. In some cases, e.g., at 82 where there is only one winner, this may be revealed before all the flaps 80 are opened (FIG. 6).

The front face 90 of each of the double win tickets 70 may be printed with the possible outcomes for the second bonus round and may have a serial number corresponding to a serial number printed on the master game card 12. In the illustrated embodiment, there are four possible outcomes for the second bonus round. Each of the double win tickets 70 preferably identifies a different one of the outcomes, although it is also contemplated that two or more of the double win tickets 70 may identify the same outcome. For example, the selected double win ticket provides one of the following four general outcomes (i) an award of the entire double win round prize ($500.00 in the illustrated embodiment) to the double win player; (ii) an award of a portion of the double win round prize ($300.00 in the illustrated embodiment) to the double win player and award the balance of the double win round prize to one or more of the selected non-winning eligible selected players (in the illustrated embodiment at 84 in FIG. 6, the balance of the double win round prize is split between the two players whose names are listed adjacent that of the double win player, e.g., $100.00 each to players 1713 and 1913, termed "up and down wins"); (iii) the double win round prize is split between two players ($250.00 to each winner, shown at 88 in the illustrated embodiment); and (iv) the double win round prize is split between five players ($100.00 to each winner shown at 90 in the illustrated embodiment).

It will be appreciated that the double win player may win all, a portion, or none of the double win round prize, depending on the instructions on the selected bonus card. Or, as shown in the illustrated embodiments, the instructions may be formatted such that the double win player is assured of winning at least the minimum amount ($100.00 as shown at 90) of the possible prize outcomes. Preferably, there are at least three, more preferably, four or more bonus round tickets 70, with at least three, more preferably, all, of the bonus round tickets providing a different outcome.

Additionally, to add to the excitement, one or more of the flaps 80 may reveal that the double win player has won a prize, but without specifying the amount (see, e.g., 88 FIG. 6). The double win player then has to open an additional flap or flaps to see what amount has been won and who is/are the other winner(s).

The assembled double win game system includes a set of playing cards 10 and a master game card 12 as well as a printed set of instructions for play 96 (FIG. 6). The set of playing cards 10 and master game card 12, with bonus round tickets 70, are preferably packaged together with the instructions 96, such as in a clear wrapping (not shown). Or, the instructions may be provided separately, for use with several packaged sets of playing cards and master game card. The instructions may include information about the payout, which can be a definite payout, such when the three rounds described above are played and all of the cards are sold. The profit for the game organizer can also be displayed, based on the total income from the cards 10 and the definite payout, optionally also taking into account the cost to the organizer of the set of cards. In another embodiment, no playing card price is set on the playing card. The game proprietor can thus determine the payout ratio or design its own game.

As will be appreciated, variations of the present system can be made within the purview of the present invention. As noted, the playing cards 10 can be otherwise configured, as can the master game card 12. If desired, more than the disclosed three or four levels of play can be provided. Additionally, plural arrangements can be provided for establishing the eligibility for bonus play of selected double win players. For example, two listings 50 of eligible players can be provided on the master game card 12, with two different criteria identified for establishing eligibility. The playing card 10 is exemplary of the present invention in that the present game system includes a plurality of such playing cards such as, for example, 200 cards, 500 cards, or in the illustrated embodiment, about 2000 cards. Each of these playing cards 10 is separately purchased by a game player.

In another embodiment, a random method may be used to determine the eligible symbol for the second and third levels of the game, for example, by calling a BINGO-type ball withdrawn from a hopper.

The invention has been described with reference to the preferred embodiments. Obviously, alterations and modifications will occur to others upon a reading and understanding of this specification.

I claim:

1. A system for use in playing a game of chance comprising:

a plurality of playing cards, each of said playing cards including at least one of a plurality of game symbols displayed thereon, at least some of said playing cards each displaying an eligible game symbol from said plurality of game symbols;

a master game card for use in conjunction with said plurality of playing cards, at least one of said master game card and said playing cards including a first identifier for identifying a first award, said master game card including at least one winning game symbol selected from said eligible game symbols associated with said identified first award; and a plurality of bonus round tickets for use in conjunction with said master game card, wherein less than the plurality of bonus round tickets are used with the master game card in any given game, each of said bonus round tickets having at least one bonus round award identifier for identifying a bonus round award and at least one bonus round winning game symbol selected from said eligible game symbols associated with said identified bonus round award, said bonus round tickets differing in their outcomes, such that, depending on which bonus round ticket is selected from said less than the plurality of bonus round tickets, different ones or combinations of game symbols are determined to be bonus round winning game symbols depending on which of the bonus round tickets is selected in the game of chance.

2. The system of claim 1, wherein said plurality of bonus round tickets are selectively detachable from said master game card.

3. The system of claim 1, wherein at least one of said bonus round tickets displays said winning game symbol associated with said identified first award.

4. The system of claim 1, wherein a plurality of said bonus round tickets provide different outcomes in that:

at least a first of said bonus round tickets displays a bonus round award which is associated with a first of said eligible game symbols; and at least a second of said bonus round tickets displays a bonus round award which is associated with a second of said eligible game symbols.

5. The system of claim 1, wherein a plurality of said bonus round tickets provide different outcomes in that:

at least a first of said bonus round tickets displays a first bonus round award which is associated with a first of said eligible game symbols; and at least a second of said bonus round tickets displays a second bonus round award, which differs in value from said first bonus round award, which is associated with said first of said eligible game symbols.

6. The system of claim 1, wherein there are at least three bonus round tickets and wherein each of said bonus round tickets provides a different outcome.

7. The system of claim 6, wherein there are four bonus round tickets, at least three of said bonus round tickets providing a different outcome.

8. The system of claim 1, wherein at least one of said bonus round tickets includes at least two bonus round winning game symbols selected from said eligible game symbols, each of said at least two bonus round winning game symbol associated with a bonus round award.

9. The system of claim 1, wherein said bonus round award includes a plurality of bonus round awards and wherein a total of said bonus round awards for each of said bonus round tickets is the same.

10. The A system for use in playing a game of chance comprising:

a plurality of playing cards, each of said playing cards including at least one of a plurality of game symbols displayed thereon, at least some of said playing cards each displaying an eligible game symbol from said plurality of game symbols;

a master game card for use in conjunction with said plurality of playing cards, at least one of said master game card and said playing cards including a first identifier for identifying a first award, said master game card including at least one winning game symbol selected from said eligible game symbols associated with said identified first award; and a plurality of bonus round tickets for use in conjunction with said master game card, said bonus round tickets each having at least one bonus round award identifier for identifying a bonus round award and at least one bonus round winning game symbol selected from said eligible game symbols associated with said identified bonus round award, and wherein said winning game symbol selected from said eligible game symbols associated with said identified first award is also a bonus round winning game symbol on each of said bonus round tickets.

11. The system of claim 1, wherein at least three bonus round tickets each provide a different one of the following outcomes:

a) a total of the bonus round awards is associated with only one eligible game symbol;

b) the total of the bonus round awards is split between only two eligible game symbols;

c) the total of the bonus round awards is split between only three eligible game symbols; and d) the total of the bonus round awards is split between at least four eligible game symbols.

12. The system of claim 1, wherein said eligible game symbols are numbers in a sequence and at least one of said bonus round tickets provides a bonus round award to at least two consecutive eligible game symbols in the sequence.

13. The system of claim 12, wherein at least one of said bonus round tickets provides a bonus round award to three consecutive eligible game symbols.

14. The system of claim 1, wherein:

said first identifier includes a first cover member for initially concealing said winning game symbol selected from said eligible game symbols associated with said identified first award;

said at least one bonus round award identifier for said bonus round tickets includes a cover member for initially concealing said corresponding bonus round winning game symbol; and said playing cards further include a cover member for initially concealing said at least one game symbol displayed thereon.

15. The system of claim 1, wherein at least one game symbol of at least one of said playing cards comprises indicia identifying said game symbol as being an instant winning game symbol.

16. The system of claim 1, wherein said master game card includes a sign up area for identifying holders of playing cards which include at least one game symbol eligible to be a winning game symbol.

17. A system for use in playing a game of chance comprising:

a plurality of playing cards, said playing cards including game symbols displayed thereon, some of said playing cards displaying an eligible game symbol from said game symbols, each of said eligible game symbols being different from said other eligible game symbols;

a master game card for use in conjunction with said plurality of playing cards;

at least one of said master game card and said playing cards including means for identifying said eligible game symbols;

said master game card including means for identifying one of said eligible game symbols as a winning game symbol;

a plurality of bonus round tickets for use in conjunction with said master game card, said bonus round tickets each having at least one award identifier for identifying a bonus round award and at least one bonus round winning game symbol selected from said eligible game symbols associated with said identified bonus round award, each of the plurality of bonus round tickets providing a different outcome, a total of the bonus round awards being the same for each of the bonus round tickets.

18. A method of playing a game of chance comprising:

distributing a plurality of playing cards to a plurality of players;

removing at least one cover member on each of said playing cards to reveal at least one of a plurality of game symbols, some of said playing cards including an eligible game symbol of said game symbols which is eligible for a first bonus round of play;

in the first bonus round of play, uncovering a winning game symbol selected from said eligible game symbols associated with a first award, a holder of the playing card displaying the winning game symbol receiving the first award; and in a second bonus round of play, the holder of the playing card displaying the winning game symbol selecting one of a plurality of bonus round tickets, said bonus round tickets each having at least one bonus round award identifier for identifying at least one bonus round award and at least one bonus round winning game symbol selected from said eligible game symbols associated with said identified bonus round award, whereby a total bonus round award is distributed, a total value of said at least one bonus round awards being the same for each of the bonus round tickets, irrespective of which of the bonus round tickets is selected.

19. A method of playing a game of chance, comprising:

distributing a plurality of playing cards to a plurality of players;

removing cover members on said playing cards to reveal a plurality of game symbols, some of said playing cards including a game symbol which is eligible for a bonus round of play; and uncovering a winning game symbol selected from said eligible game symbols, a holder of the playing card displaying the winning game symbol being permitted to select one of a plurality of bonus round tickets, said bonus round tickets providing different outcomes by which a total bonus round award is distributed, the outcomes providing for different combinations of game symbols to share in the total award, depending on which ticket is selected, each having at least one bonus round award identifier for identifying a bonus round award and at least one bonus round winning game symbol selected from said eligible game symbols associated with said identified bonus round award, at least one of said bonus round tickets identifying a bonus round award associated with said winning game symbol.

20. A system for use in playing a game of chance comprising:

a plurality of playing cards, said playing cards including game symbols displayed thereon, some of said playing cards displaying an eligible game symbol from said game symbols, each of said eligible game symbols being different from said other eligible game symbols;

a master game card for use in conjunction with said plurality of playing cards;

at least one of said master game card and said playing cards including means for identifying said eligible game symbols;

said master game card including means for identifying one of said eligible game symbols as a winning game symbol;

a plurality of bonus round tickets for use in conjunction with said master game card, said bonus round tickets being selectively detachable from said master game card, said detachable bonus round tickets each having a plurality of cover members and at least one award identifier for identifying a bonus round award and at least one bonus round winning game symbol selected from said eligible game symbols associated with said identified bonus round award, whereby removing at least one of said plurality of cover members reveals said at least one bonus round winning game symbol.

* * * * *